US006193314B1

(12) United States Patent
Chiang

(10) Patent No.: US 6,193,314 B1
(45) Date of Patent: Feb. 27, 2001

(54) OFFICE CHAIR WITH ADJUSTABLE BACKREST AND ADJUSTABLE SEAT

(76) Inventor: Ming-Che Chiang, No. 103-1, Section 4, Yuan Lu Road, Pu Hsin HSiang, Chang Hua Hsien (TW)

( * ) Notice: Subject to any disclaimer, the term of this patent is extended or adjusted under 35 U.S.C. 154(b) by 0 days.

(21) Appl. No.: 09/349,275

(22) Filed: Jul. 7, 1999

(51) Int. Cl.[7] ..... A47C 1/024; A47C 7/60

(52) U.S. Cl. ..... 297/301.7; 297/301.1; 297/301.5; 297/353; 297/366

(58) Field of Search ..... 297/301.1, 301.3, 297/301.4, 301.5, 301.6, 301.7, 353, 367, 368, 366

(56) References Cited

U.S. PATENT DOCUMENTS

| | | | | |
|---|---|---|---|---|
| 3,441,311 | * | 4/1969 | Doerner | 287/301.4 |
| 4,123,103 | * | 10/1978 | Doerner | 297/301.4 |
| 4,183,581 | * | 1/1980 | Karrip et al. | 297/301.6 |
| 4,221,430 | * | 9/1980 | Frobose | 297/353 |
| 4,836,608 | * | 6/1989 | Sugiyama | 297/367 X |
| 5,138,744 | * | 8/1992 | Coggon | 297/367 |
| 5,918,938 | * | 7/1999 | Miotto | 297/353 |

* cited by examiner

*Primary Examiner*—Anthony D. Barfield

(74) *Attorney, Agent, or Firm*—Alan Kamrath; Rider Bennett Egan & Arundel

(57) ABSTRACT

An office chair includes a backrest, a chair seat, and a connecting device having a first end for engaging with the backrest and a second end for securely engaging with the chair seat. The first end of the connecting device includes a compartment, an inner wall defining the compartment including a slot with two spaced horizontal sections. Two slider members each include a locking member for releasably engaging with an associated positioning groove of the backrest and a sliding rod slidably received in an associated horizontal section of the slot in the connecting device. An actuator is mounted in the compartment of the connecting device and slidable in a vertical direction. The actuator includes two inclined faces. The sliding rod of each slider member abuts against an associated inclined face such that vertical movement of the actuator causes horizontal movements of the slider members along the slot. An elastic member is attached between the sliding rods for biasing the locking members of the slider members to securely engage with an associated pair of the positioning grooves of the connecting device, thereby retaining the backrest in a desired level relative to the chair seat. A manually operable adjusting button is securely attached to the actuator for urging the actuator to move in the vertical direction, such that the sliding rods of the slider members move away from each other to disengage the locking members of the slider members from the associated pair of the positioning groove, thereby allowing the backrest to be movable in the vertical direction relative to the chair seat.

12 Claims, 18 Drawing Sheets

E–E

F-F

F-F

C-C

B-B

C-C

B-B

A-A

A-A

D-D

D–D

OFFICE CHAIR WITH ADJUSTABLE BACKREST AND ADJUSTABLE SEAT

BACKGROUND OF THE INVENTION

1. Field of the Invention

The present invention relates to an office chair that allows the backrest to be adjustable in the vertical direction and in the inclination relative to the chair seat and that allows the chair seat to be adjustable in the vertical direction.

2. Description of the Related Art

An indoor worker may have to spend several hours sitting on a chair while working. A good office chair should allow adjustment in the backrest and in the chair seat to suit the user. Existing office chairs allow adjustment, yet the retaining effect is insufficient to keep the backrest at the required inclination angle. In addition, the device for adjusting the level of the chair seat is not compatible with other adjusting devices for office chairs.

The present invention is intended to provide an office chair that mitigates and/or obviate the above problems.

SUMMARY OF THE INVENTION

It is a primary object of the present invention to provide an improved office chair that allows the backrest to be adjustable in the vertical direction and in the inclination relative to the chair seat and that allows the chair seat to be adjustable in the vertical direction. The swaying extent of the backrest is also adjustable.

In accordance with a first aspect of the invention, a chair comprises:

a backrest including a plurality of pairs of vertically spaced positioning grooves defined therein, a chair seat, a connecting means including a first end for engaging with the backrest and a second end for securely engaging with the chair seat, the first end of the connecting means including a compartment, an inner wall defining the compartment including a slot with two spaced horizontal sections, two slider members each including a locking member for releasably engaging with an associated said positioning groove of the backrest and a sliding rod slidably received in an associated said horizontal section of the slot in the connecting means, an actuator mounted in the compartment of the connecting means and slidable in a vertical direction, the actuator including two inclined faces, said sliding rod of each said slider member abutting against an associated said inclined face such that vertical movement of the actuator causes horizontal movements of the slider members along the slot, an elastic member attached between the sliding rods for biasing the locking members of the slider members to securely engage with an associated said pair of the positioning grooves, thereby retaining the backrest in a desired level relative to the chair seat, and a manually operable adjusting button securely attached to the actuator for urging the actuator to move in the vertical direction, such that the sliding rods of the slider members move away from each other to disengage the locking members of the slider members from the associated said pair of the positioning groove, thereby allowing the backrest to be movable in the vertical direction relative to the chair seat.

The backrest includes a first backrest part and a second backrest part securely attached to the first backrest part, wherein the first backrest part includes a block in which the positioning grooves are defined.

The first end of the connecting means further includes an opening, and the actuating member includes a second slot and the adjusting button includes an engaging piece extended through the opening for securely engaging with the second slot of the connecting means.

The chair may further comprise:

a central seat secured to the chair seat, a swaying seat including a first end securely connected to the second end of the connecting means and a second end pivotally engaged with the central seat, an adjusting rod including a mediate portion pivotally connected to the central seat, a first end outside the central seat for manual operation and a second end, and an adjusting member slidably mounted to the central seat, the adjusting member being operably connected to the second end of the adjusting rod for releasable engagement with the second end of the swaying seat, the adjusting member being normally engaged with the second end of the swaying seat, wherein when the first end of the adjusting rod is moved in a first direction, the adjusting member is urged to disengage from the second end of the swaying seat, thereby allowing the swaying seat to be adjustable in an inclination angle relative to the chair seat, and when the first end of the adjusting rod is moved in an opposite second direction, the adjusting member is urged to engage with the second end of the swaying seat, thereby retaining the swaying seat in a desired inclination angle relative to the chair seat.

The adjusting member includes a first toothed section and the second end of the swaying seat includes a second toothed section to provide releasable engagement therebetween.

The chair may further comprise:

a second elastic member having a first end securely attached to the swaying seat and a second end, an adjusting knob including a threaded stem, an abutting plate including a first end engaged with the central seat and a second end resting on the second end of the second elastic member, and a nut threadedly engaged on the threaded stem of the adjusting knob, a portion of the abutting plate being held in place relative to the second end of the second elastic member, wherein rotational movement of the adjusting knob causes the second end of the second elastic member to be moved relative to the first end of the second elastic member, thereby adjusting swaying extent of the swaying seat relative to the chair seat in forward and rear directions of the chair.

The chair may further comprise:

a chair base, a pneumatic supporting means telescopically extended between the chair seat and the chair and base of the chair, an adjusting rod having a first end for manual operation and a second end operably connected to the pneumatic supporting means for adjusting a level of the chair seat relative to the chair base upon manual operation on the first end of the adjusting rod.

In accordance with a second aspect of the invention, a chair comprises:

a backrest, a chair seat, a connecting means including a first end for engaging with the backrest and a second end, a central seat secured to the chair seat, a swaying seat including a first end securely connected to the second end of the connecting means and a second end pivotally engaged with the central seat, an adjusting rod including a mediate portion pivotally connected to the central seat, a first end outside the central seat for manual operation and a second end, and an adjusting member slidably mounted to the central seat, the adjusting member being operably connected to the second end of the adjusting rod for releasable engagement with the second end of the swaying seat, the adjusting member being normally engaged with the second end of the swaying seat, wherein when the first end of the adjusting rod is moved in a first direction, the adjusting member is urged to disengage from the second end of the swaying seat, thereby allowing the swaying seat to be adjustable in an inclination angle relative to the chair seat, and when the first end of the adjusting rod is moved in an opposite second direction, the adjusting member is urged to engage with the second end of the swaying seat, thereby retaining the swaying seat in a desired inclination angle relative to the chair seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
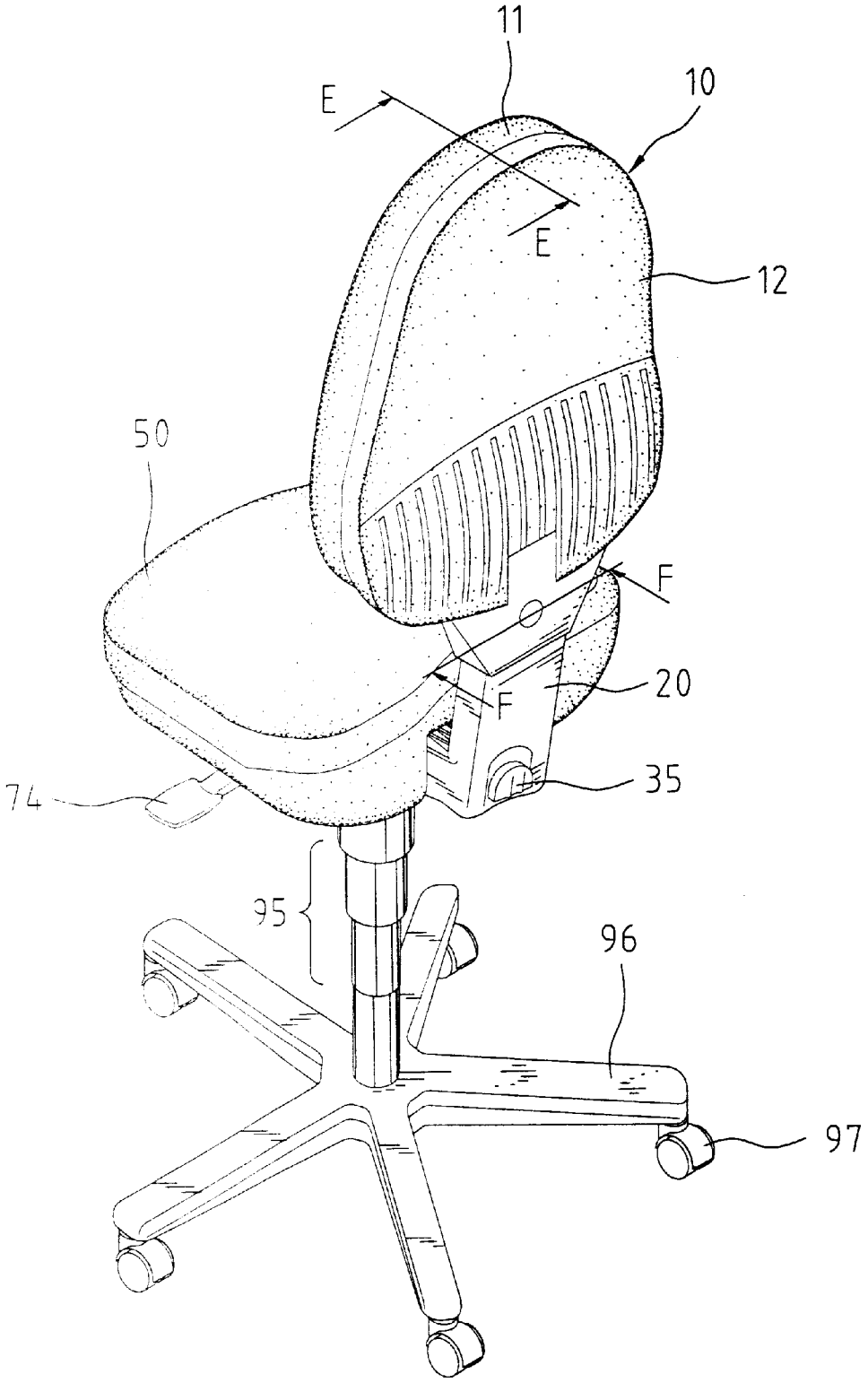
FIG. 1 is a perspective view of an office chair in accordance with the present invention.
Figure 2:
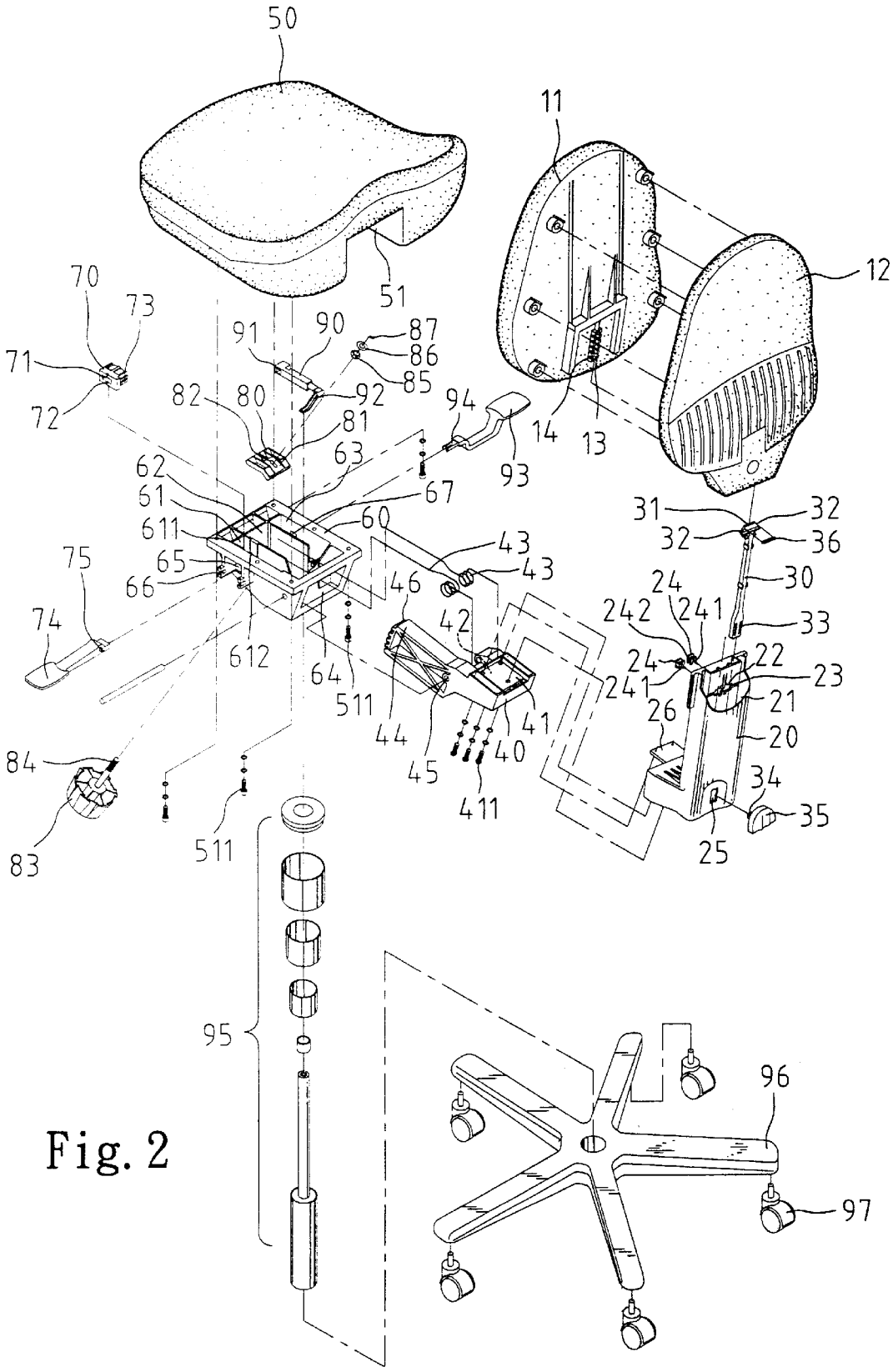
FIG. 2 is an exploded perspective view of the office chair in accordance with the present invention.
Figure 3:
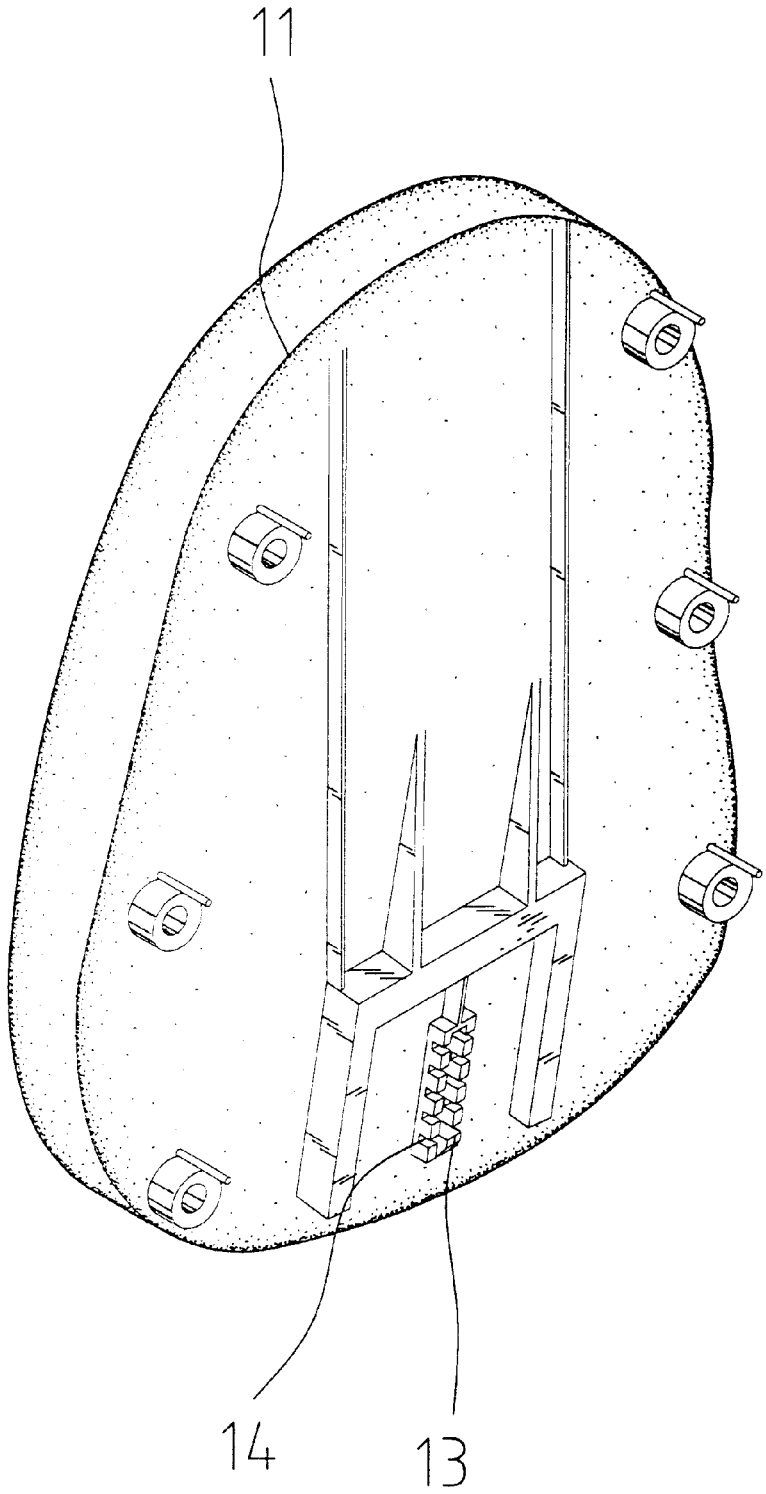
FIG. 3 is an enlarged perspective view of a part of a backrest of the office chair in accordance with the present invention.
Figure 4:
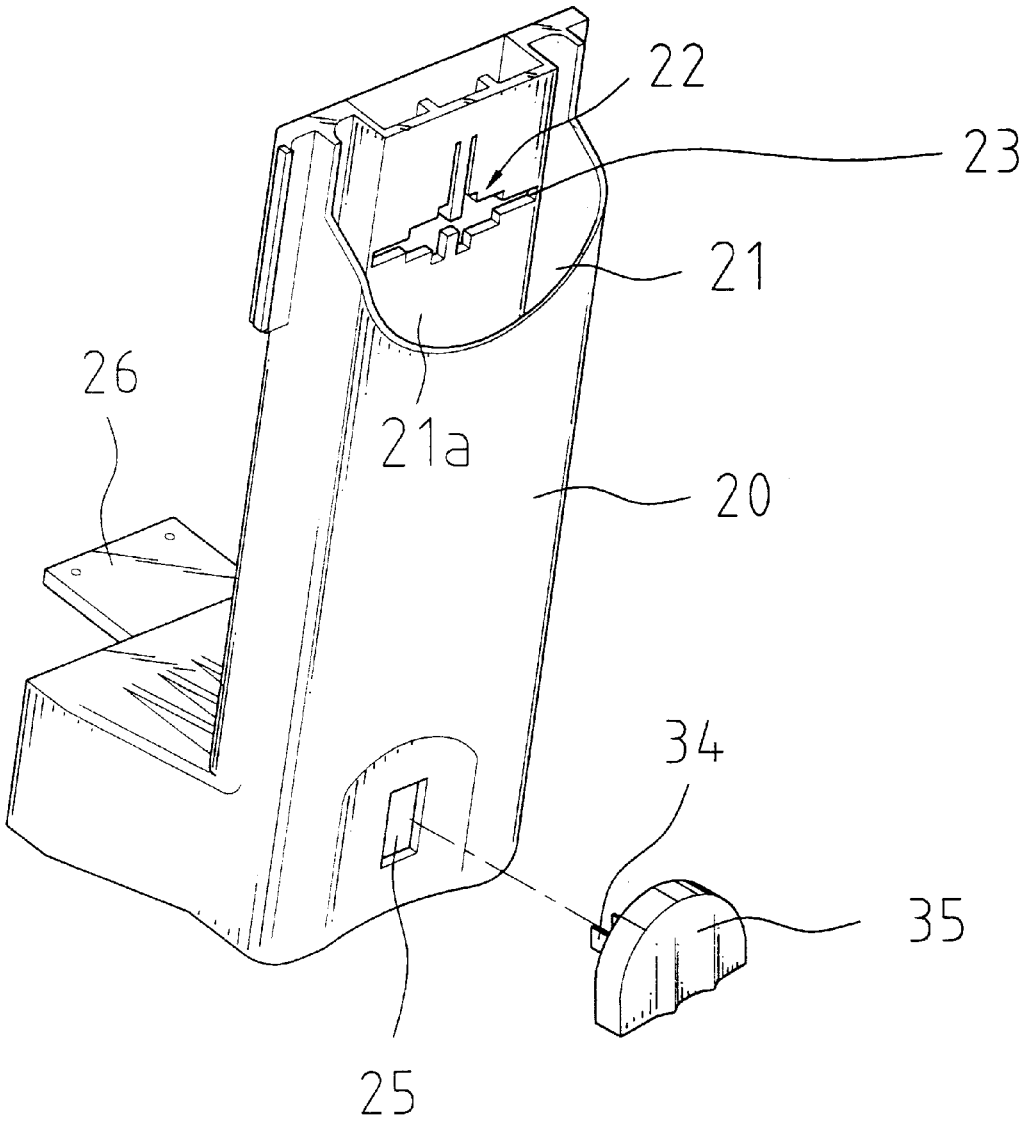
FIG. 4 is an enlarged perspective view of a connecting means for connecting the backrest and the chair seat of the office chair in accordance with the present invention.
Figure 5:
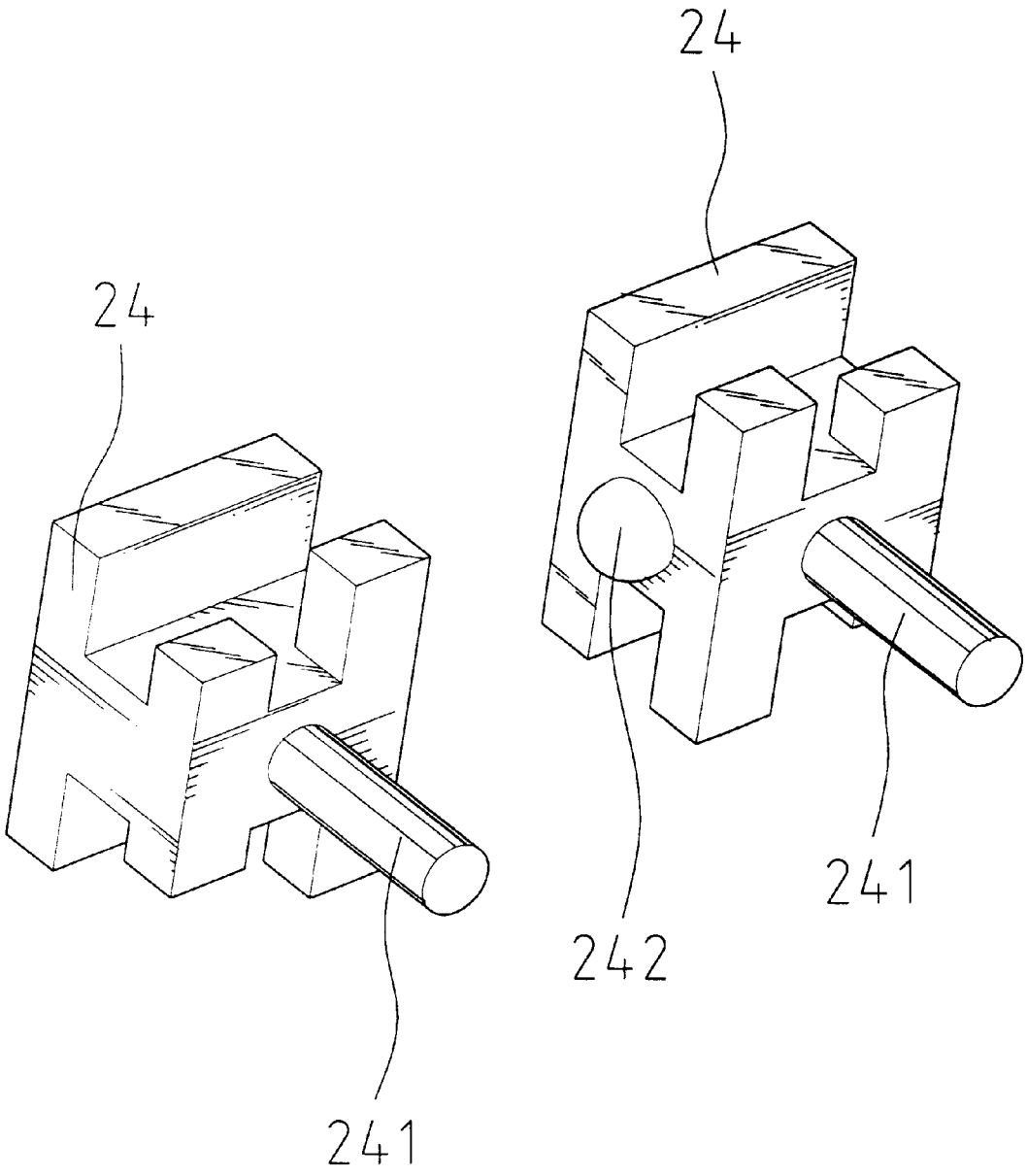
FIG. 5 is an enlarged perspective view of two slider members of the office chair in accordance with the present invention.

Referring to FIGS. 1 and 2, an office chair in accordance with the present invention generally includes a backrest 10 consisting of a first backrest part 11 and a second backrest part 12. The first backrest part 11 includes a block 13 with a plurality of pairs of vertically spaced positioning grooves 14, best shown in FIG. 3. Referring to FIG. 4, the office chair further includes a substantially L-shape connecting means 20. The connecting means 20 includes a first part having a compartment 21 defined therein and a second part with an engaging section 26. An inner wall 21*a* defining the compartment 21 has a slot 22 with two aligned horizontal sections 23 for engaging with two sliding rods 241 of two slider members 24 (FIG. 5). Each slider member 24 includes a locking member 242 that is engaged in one of the positioning grooves 14 of the first backrest part 11. The first part of the connecting means 20 further includes an opening 25 defined in an end adjacent to the second part.

Figure 6:
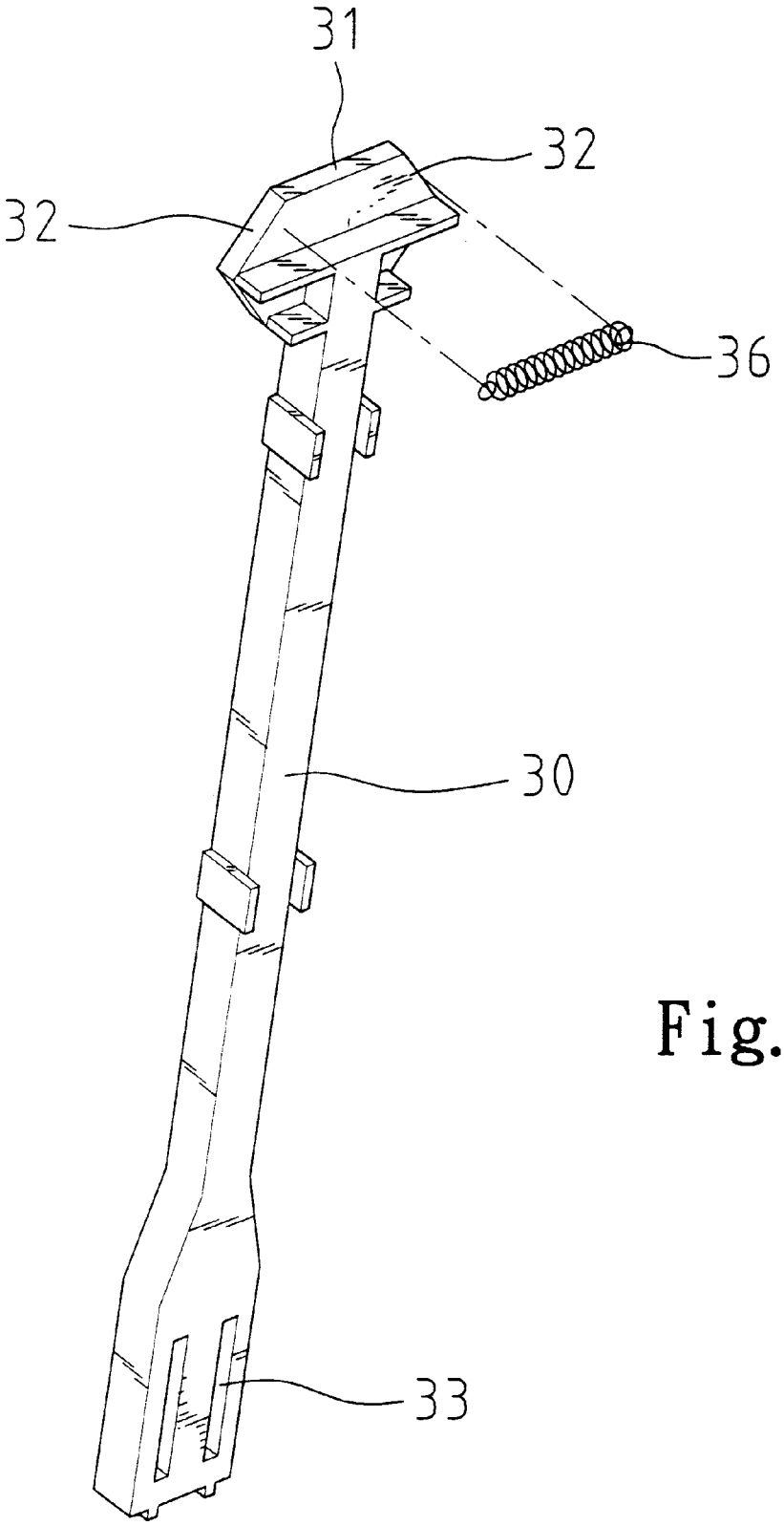
FIG. 6 is an enlarged perspective view of an actuator of the office chair in accordance with the present invention.

Referring to FIG. 6, the office chair further includes an actuator 30 that is mounted in the compartment means 20 of the connecting means 21. The actuator 30 includes a first end with a hexagonal abutting section 31 formed thereon. The hexagonal abutting section 31 has two inclined operative faces 32. A second end of the actuator 30 has two slots 33 for securely engaging with two engaging pieces 34 of an adjusting button 35 (FIGS. 2 and 4) that extend through the opening 25 of the connecting means 20 (FIG. 4). Thus, the actuator 30 moves vertically in response to vertical movement of the adjusting button 35 upon manual operation.

Figure 7:
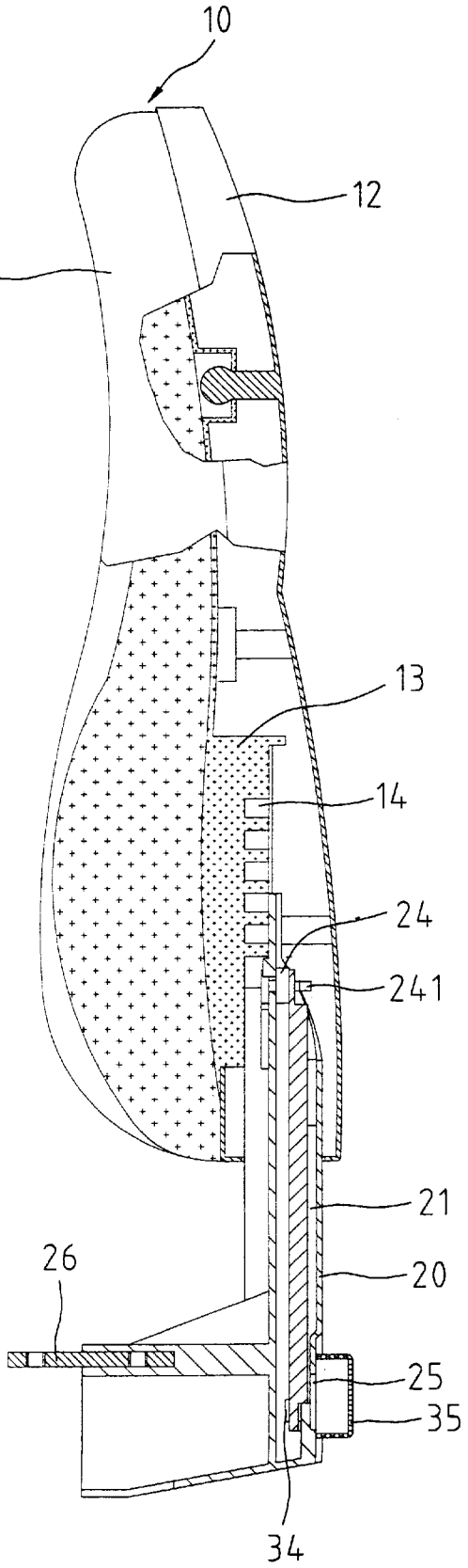
FIG. 7 is a partially sectioned side view, taken along line E—E in FIG. 1, of the backrest of the office chair in accordance with the present invention.
Figure 8:
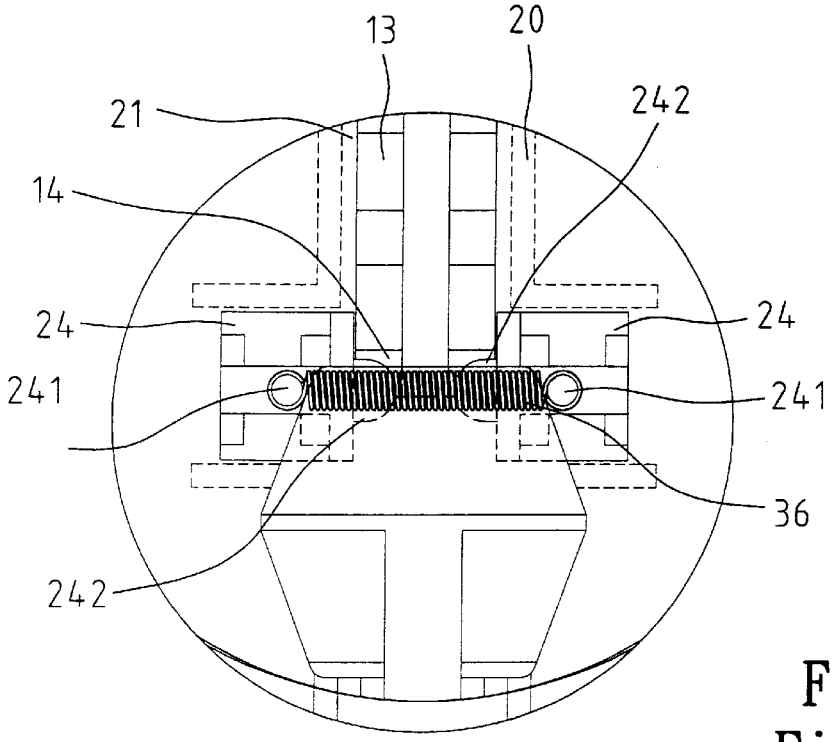
FIG. 8 is a sectional view, in an enlarged scale, taken along line F—F in FIG. 1, wherein the slider members are in engaged positions.
Figure 9:
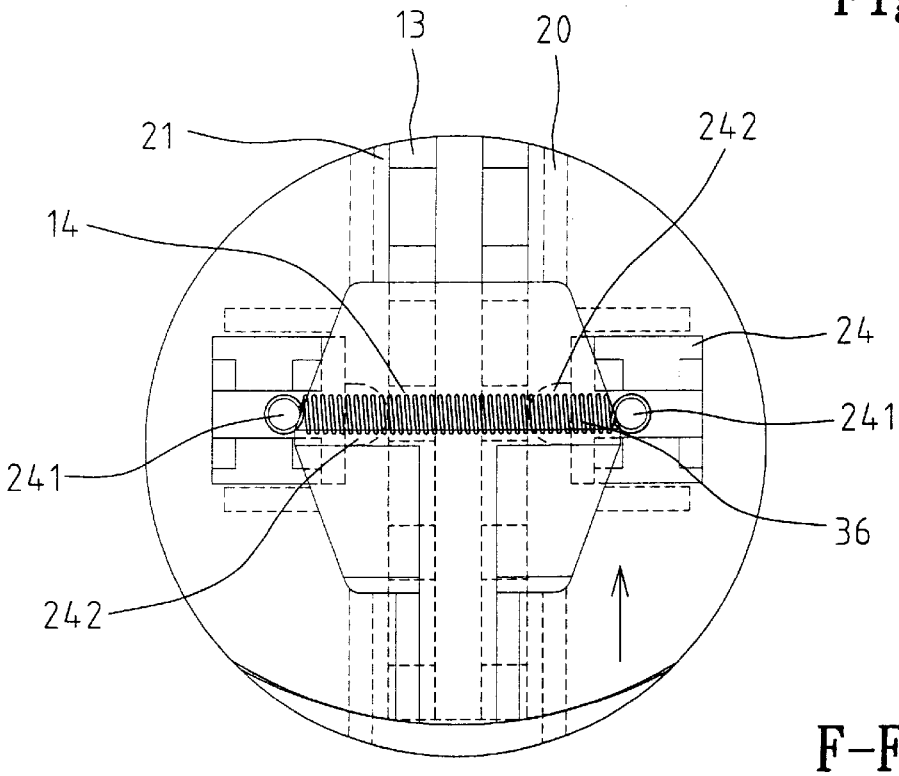
FIG. 9 is a sectional view similar to FIG. 8, wherein the slider members are displaced from the engaged positions to allow adjustment in the elevation of the backrest.

FIG. 7 illustrates engagement of the connecting means 20 and the actuator 30 to the first backrest part 11 and the second backrest part 12. The sliding rod 241 of each slider member 24 (FIG. 5) is slidably extended through an associated horizontal section 23 of the slot 22 in the connecting means 20 and abuts against an associated operative face 32 of the actuator 30, best shown in FIG. 8. It is appreciated that the locking members 242 of the slider members 24 are engaged with a corresponding pair of positioning grooves 14 of the first backrest part 11 to thereby retain the backrest 10 in a desired level. An elastic member 36 is connected between the sliding rods 241. When the adjusting button 35 is moved upward, referring to FIG. 9, the actuator 30 is also moved upward such that the sliding rods 241 of the slider members 24 move away from each other under guidance by the inclined operative faces 32 of the actuator 30. Accordingly, the locking members 242 of the slider members 24 are disengaged from the positioning grooves 14 of the first backrest part 11, thereby allowing the backrest 10 to move vertically. Thus, the user may adjust the backrest 10 to the desired level and then release the adjusting button 35 which is moved downward together with the actuator 30 under the action of the elastic member 36. The sliding rods 241 of the slider members 24 are moved toward each other until the locking members 242 of the slider members 24 re-engage with the associated positioning grooves 14 of the first backrest part 11.

Figure 10:
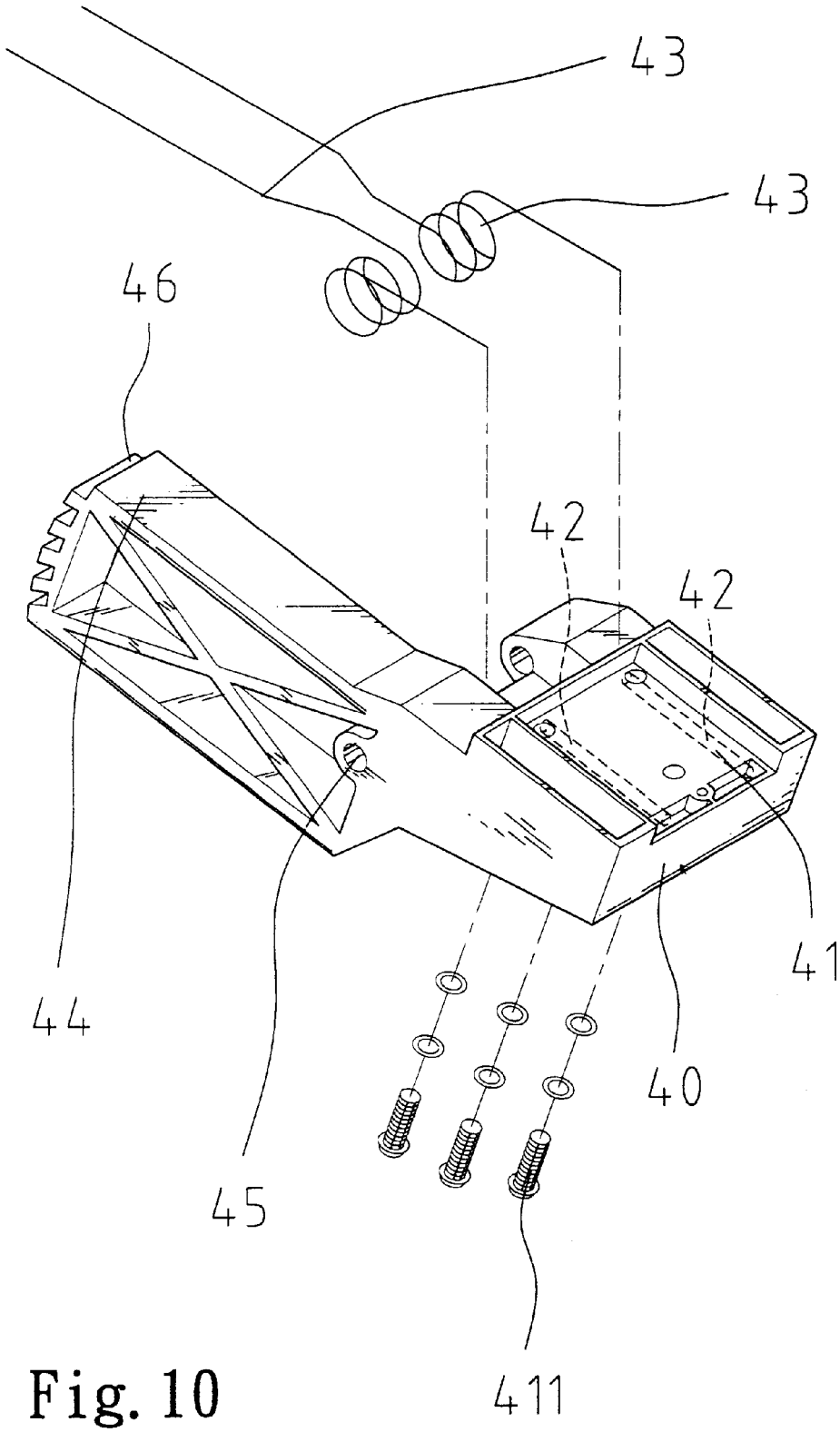
FIG. 10 is an enlarged perspective view of a swaying seat of the office chair in accordance with the present invention.
Figure 11:
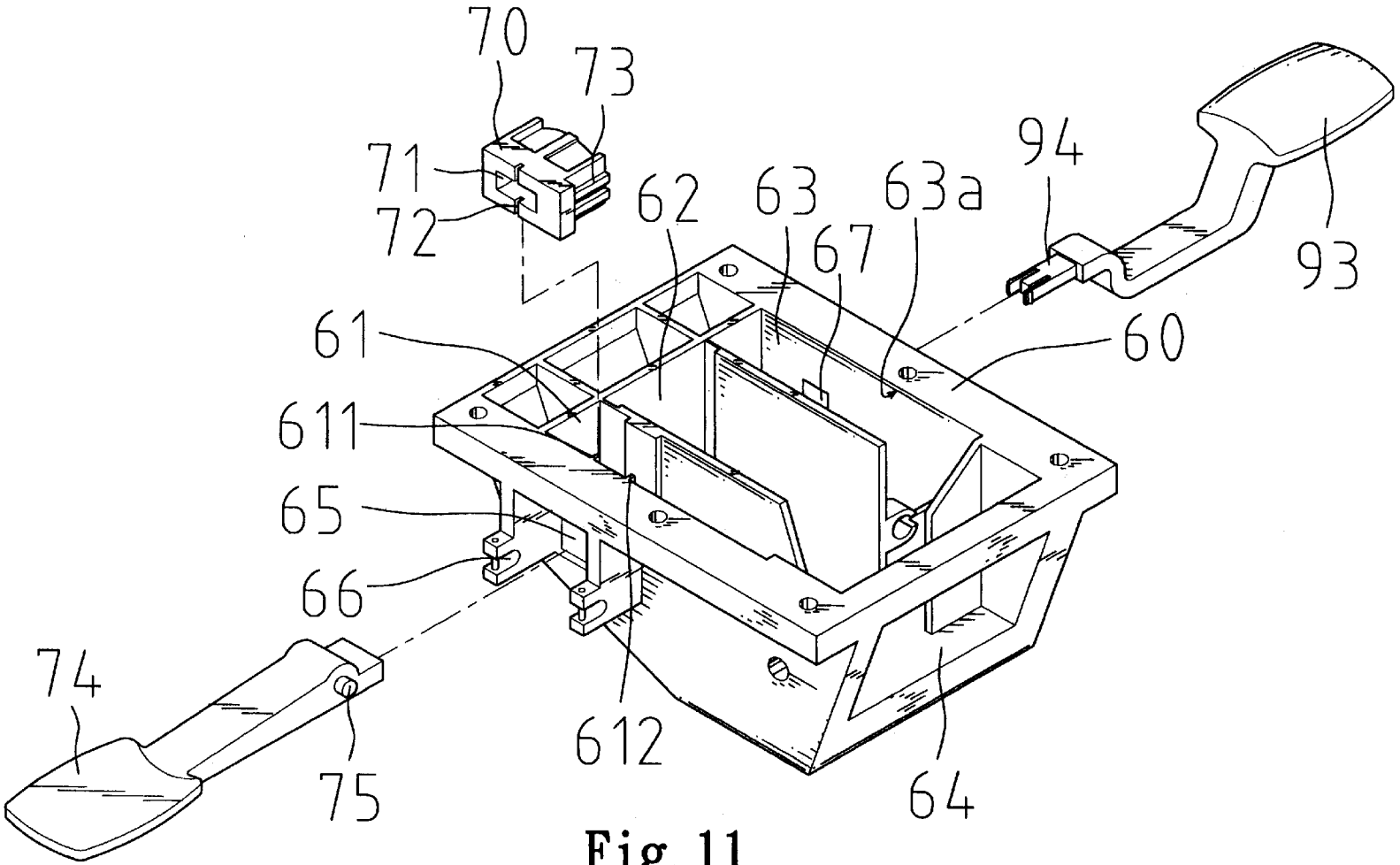
FIG. 11 is an enlarged perspective view of a central seat and two adjusting rods of the office chair in accordance with the present invention.

Referring to FIGS. 2 and 10, the engaging section 26 of the connecting means 20 is engaged with a swaying seat 40 and secured in place by screws 411. As illustrated in FIG. 10, the swaying seat 40 includes a first end with an engaging groove 41 for engaging with the engaging section 26 of the connecting means 20 and a second end 44 with a toothed section 46. A pivotal hole 45 is defined in a mediate portion of the swaying seat 40. The first end of the swaying seat 40 further includes two receptacles 42 (FIG. 18) each for receiving an end of an elastic member 43. Referring to FIGS. 1, 2, and 11, the office chair further includes a chair seat 50 with a recess 51 in an underside thereof for receiving a central seat 60, the swaying seat 40, and a portion of the second part of the connecting means 20. The central seat 60 is secured in the recess 51 of the chair seat 50 by screws 511 (FIG. 2). The central seat 60 includes a first compartment 61, a second compartment 62, and a third compartment 63. The central seat 60 further includes an opening 64 through which the toothed section 46 of the swaying seat 40 is placed into the first compartment 61. A pivotal shaft 451 (FIG. 18) is extended through the pivotal hole 45 of the swaying seat 40 and extended across in the first compartment 61, thereby allowing the swaying seat 40 to sway about the pivotal shaft 451. Namely, the toothed section 46 of the swaying seat 40 is swayable in the first compartment 61. A side wall 61*a* (FIG. 13) defining the first compartment 61 includes a side opening 65 that communicates with the first compartment 61, which will be described later. A pivotal seat 66 is provided to the side wall 61*a* adjacent to the side opening 65. The side wall 61*a* further includes an inner face 61*b* (FIG. 13) with a projection 611 and a stop 612 formed thereon. A side wall 63*a* that defines the third compartment 63 also has a side opening 67. Still referring to FIGS. 11 and FIG. 13, a first adjusting rod 74 is pivotally connected to the pivotal seat 66 on the central seat 60 by studs 75 and includes a first end outside the central seat 60 for manual operation and a second end to which an adjusting member 70 is connected. The adjusting member 70 includes an engaging slot 71 for receiving the second end of the adjusting rod 74. The adjusting member 70 further includes a vertical notch 72 that slidingly receives with the projection 611 in the first compartment 61 of the central seat 60. The adjusting member 70 further includes a toothed section 73 that meshed with the toothed section 46 of the swaying seat 40. The stop 612 assists in positioning of the adjusting member 70.

Figure 14:
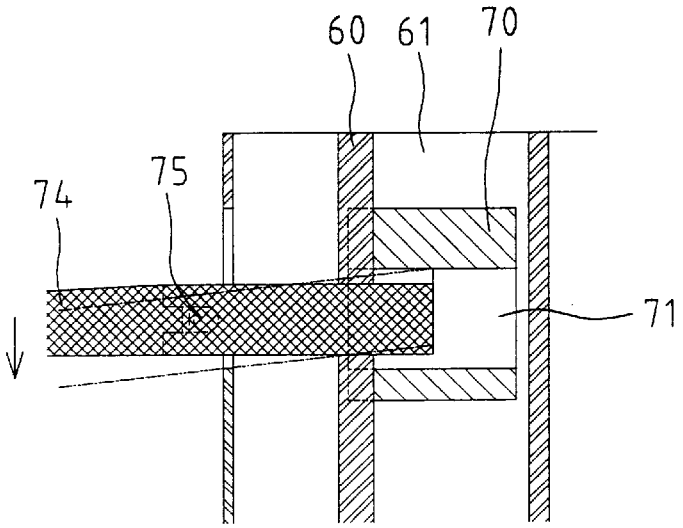
FIG. 14 is a sectional view taken along line C—C in FIG. 13, wherein an operative end of the first adjusting rod is pressed downward.
Figure 15:
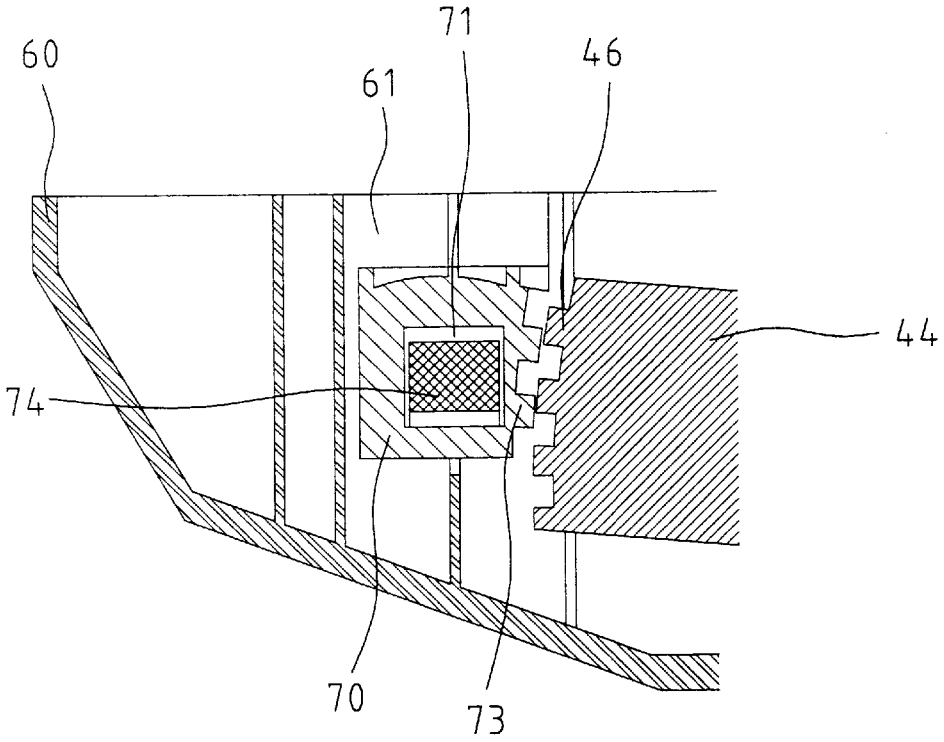
FIG. 15 is a sectional view taken along line B—B in FIG. 13, wherein the operative end of the first adjusting rod is pressed downward.
Figure 16:
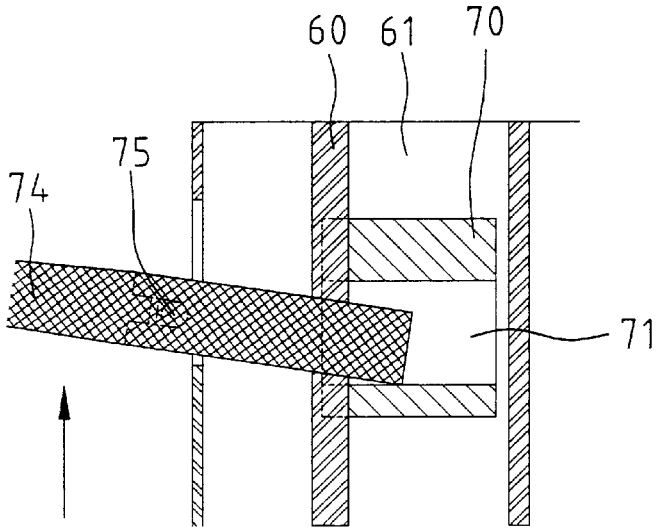
FIG. 16 is a sectional view similar to FIG. 14, wherein the operative end of the first adjusting rod is moved upward.
Figure 17:
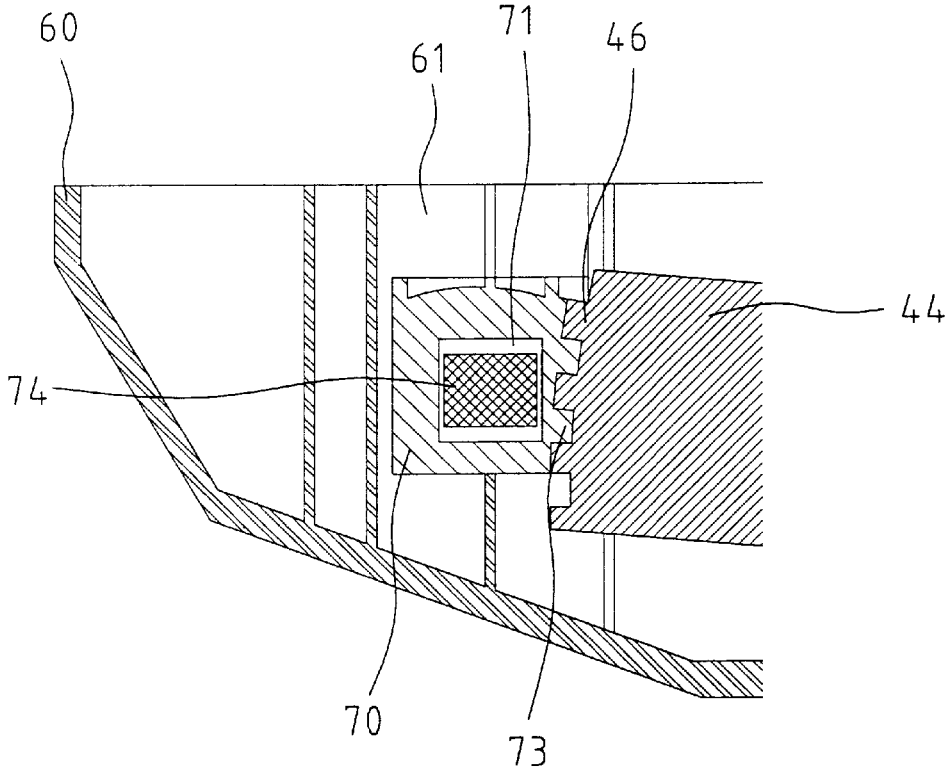
FIG. 17 is a sectional view similar to FIG. 15, wherein the operative end of the first adjusting rod is moved upward.

Referring to FIGS. 14 and 15, when adjustment in the inclination angle of the backrest 10 is required, the first end of the adjusting rod 74 is pressed downward, the adjusting member 70 is moved upward such that the toothed section 73 of the adjusting member 70 disengages from the toothed section 46 of the swaying seat 40. The swaying seat 40 is then pivoted about the pivotal shaft 451 to a desired inclination angle. Next, the adjusting rod 74 is pressed upward until the toothed section 73 of the adjusting member 70 is moved to re-engage with the toothed section 46 of the swaying seat 40, as shown in FIGS. 16 and 17. Thus, the swaying seat 40 is retained in a new position. Namely, the inclination angle of the backrest 10 relative to the chair seat 50 is also changed, as the swaying seat 40 is securely connected to the backrest 10 via the connecting means 20 and the central seat 60 is secured to the chair seat 50.

Figure 12:
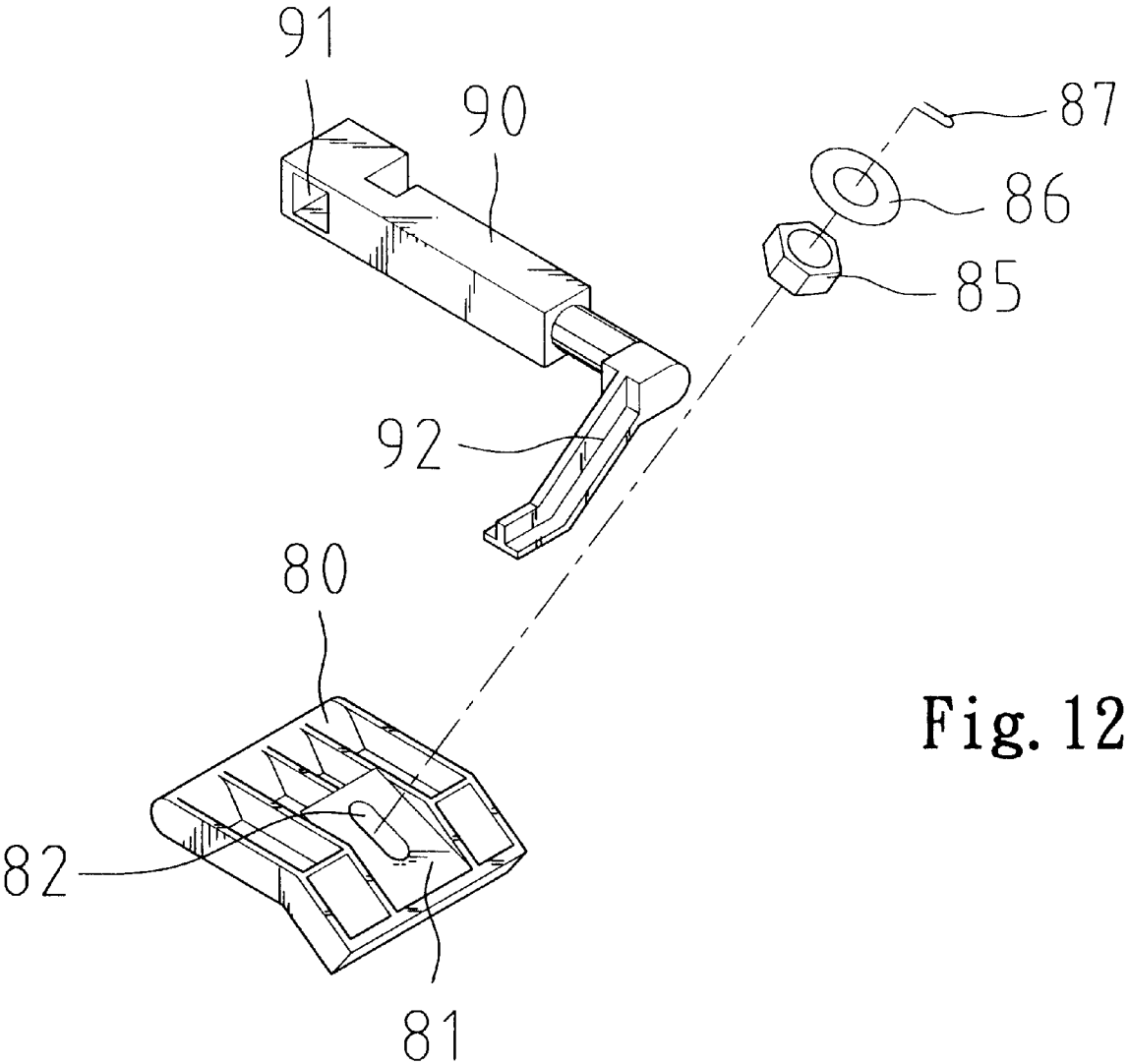
FIG. 12 is an exploded perspective view of a follower and an abutting plate of the office chair in accordance with the present invention.
Figure 13:
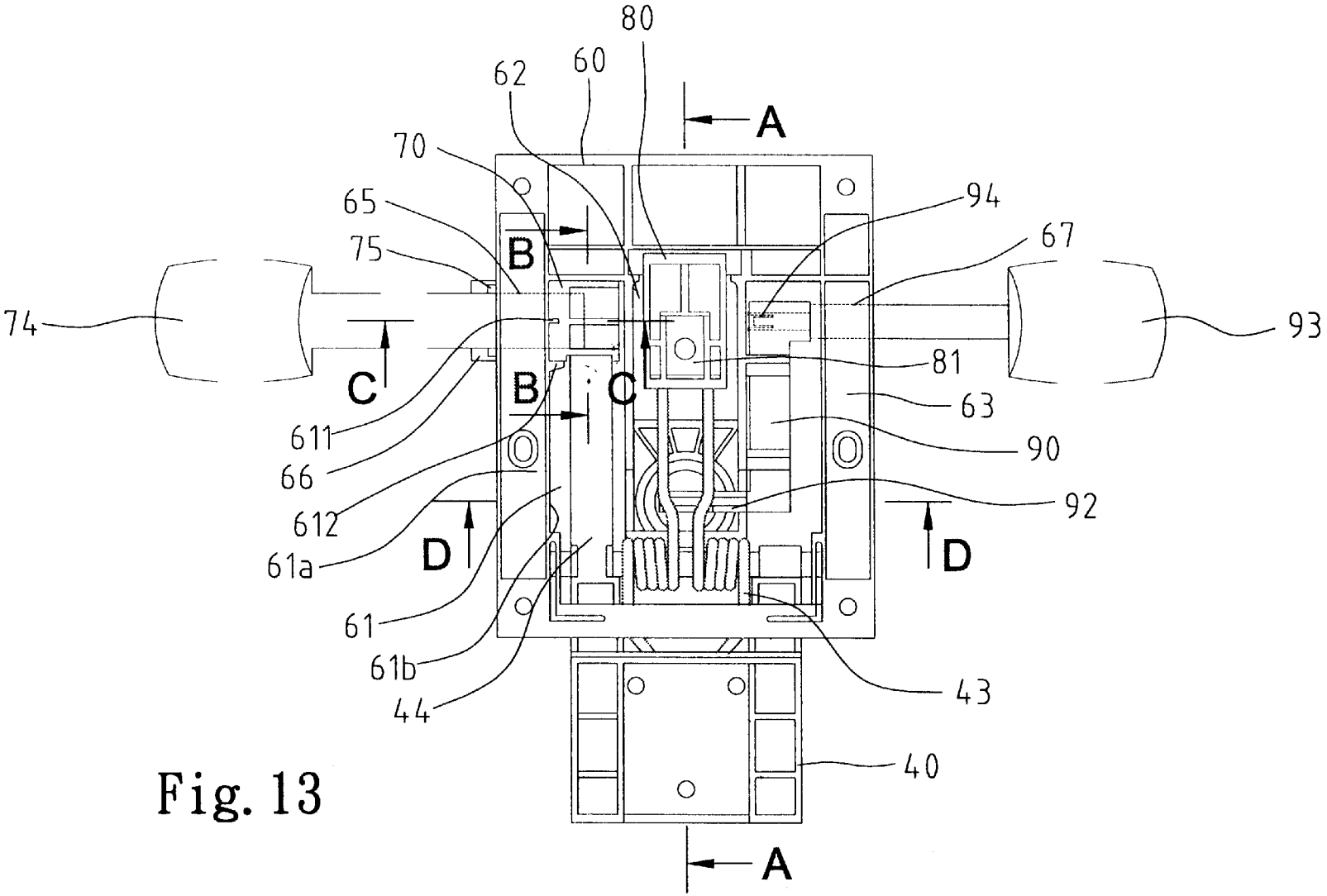
FIG. 13 is a top view of the central seat with corresponding elements assembled thereto.
Figure 18:
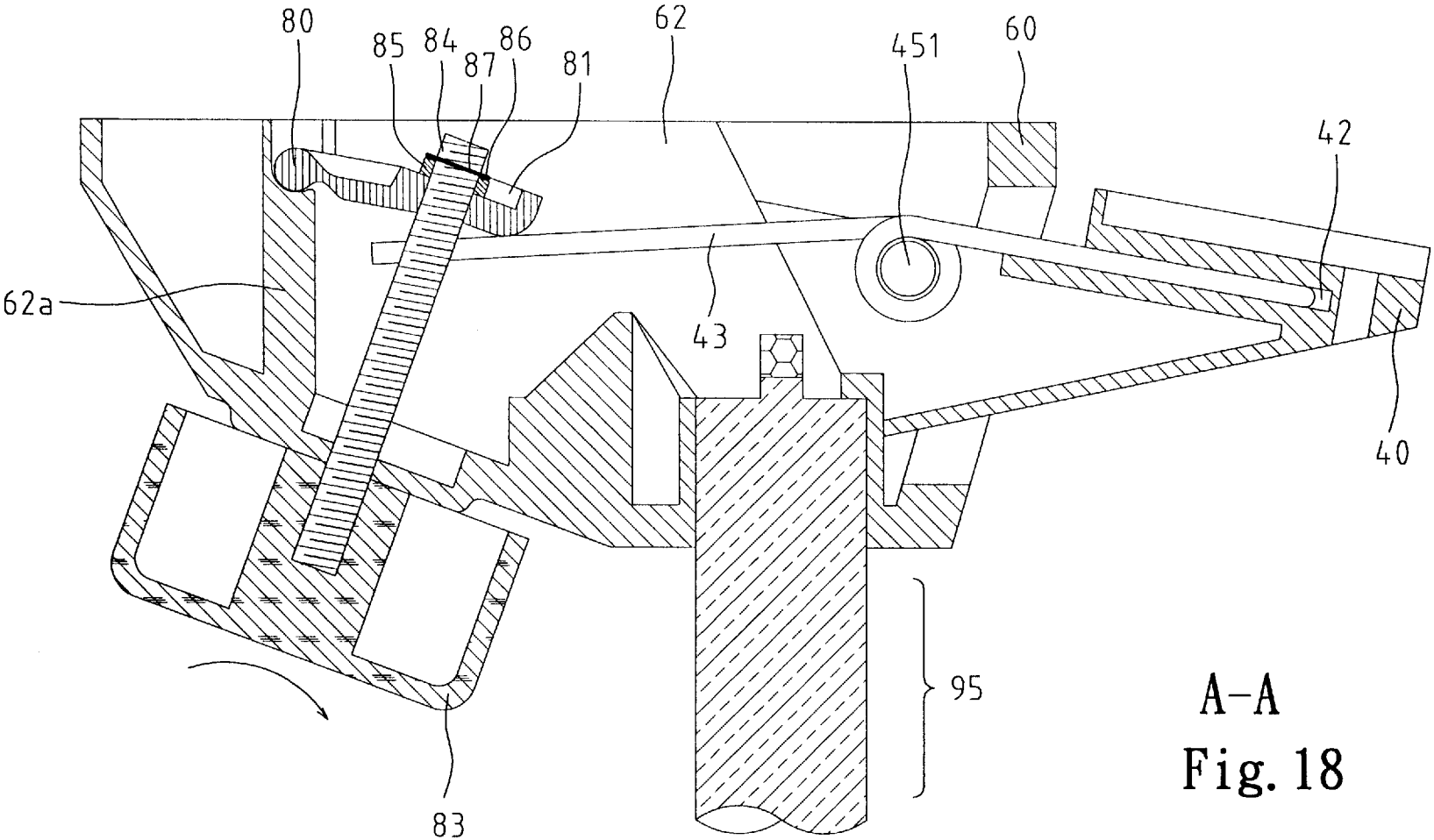
FIG. 18 is a sectional view taken along line A—A in FIG. 13, wherein the adjusting knob is tightened.
Figure 19:
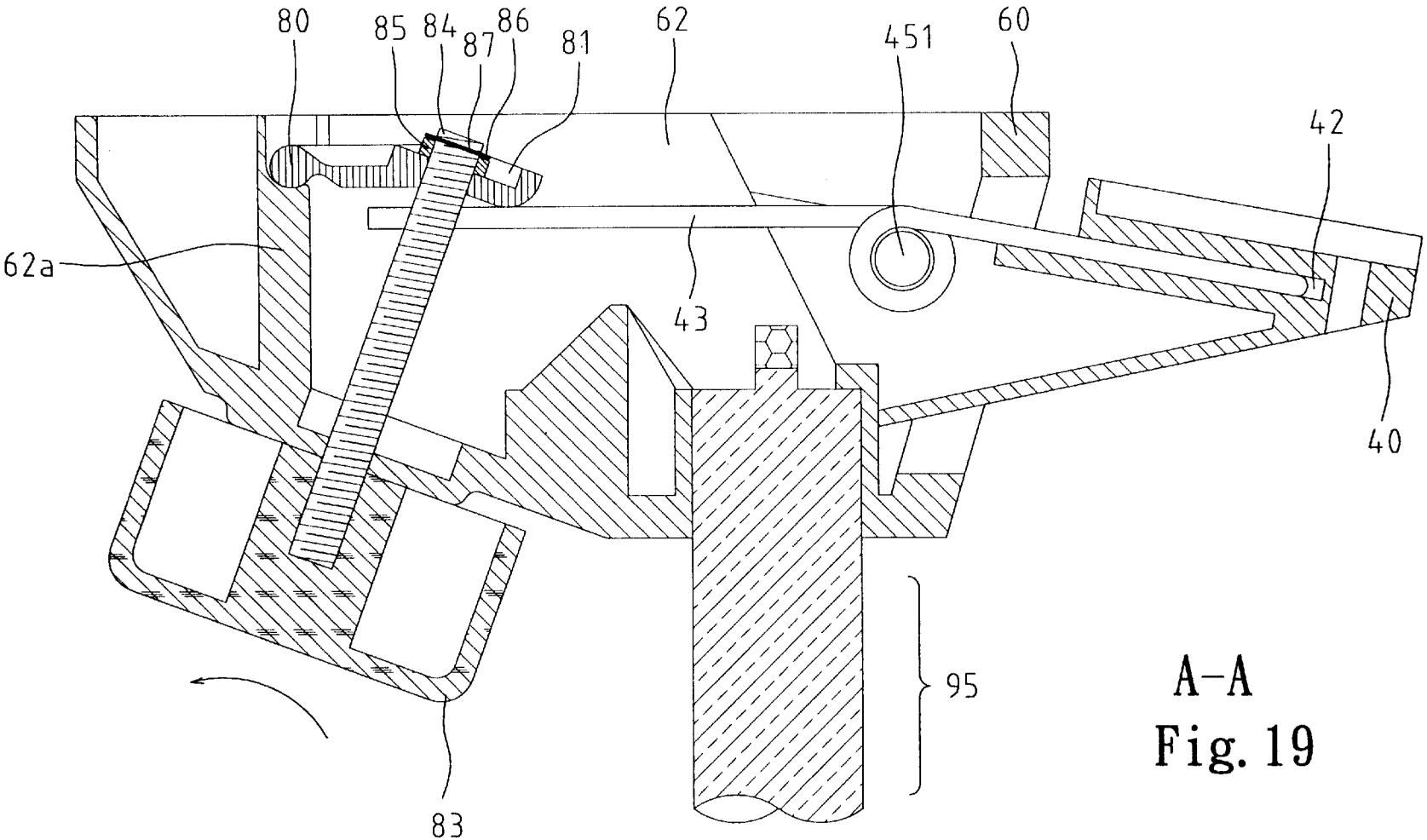
FIG. 19 is a sectional view similar to FIG. 18, wherein the adjusting knob is loosened.

Referring to FIGS. 2, 12 and 13, the office chair further includes an abutting plate 80 that is an angled member having a recessed area 81 with a slot 82. Referring to FIG. 18, an adjusting knob 83 includes a threaded stem 84 extended through the slot 82 of the abutting plate 80. A nut 85 and a washer 86 are provided to secure the abutting plate 80 in place. In addition, a positioning member 87 is provided to prevent disengagement of the nut 85 from the threaded stem 84. Still referring to FIG. 18, an end of the abutting plate 80 is engaged with a side wall 62*a* that defines the second compartment 62, and the other end of the abutting plate 80 rests on the second ends of the elastic members 43. Thus, as shown in FIG. 18, when the adjusting knob 83 is manually rotated in a direction and thus becomes more tightened, the swaying extent for the swaying seat 40 is decreased. Conversely, when the adjusting knob 83 is manually rotated in a reverse direction and thus loosened, the swaying extent for the swaying seat 40 is increased. The backrest 10 securely attached to the swaying seat 40 is swayable (forward and rearward) together with the swaying seat 40. Accordingly, swaying limitation of the backrest 10 can be adjusted by means of manually rotating the adjusting knob 83.

Figure 20:
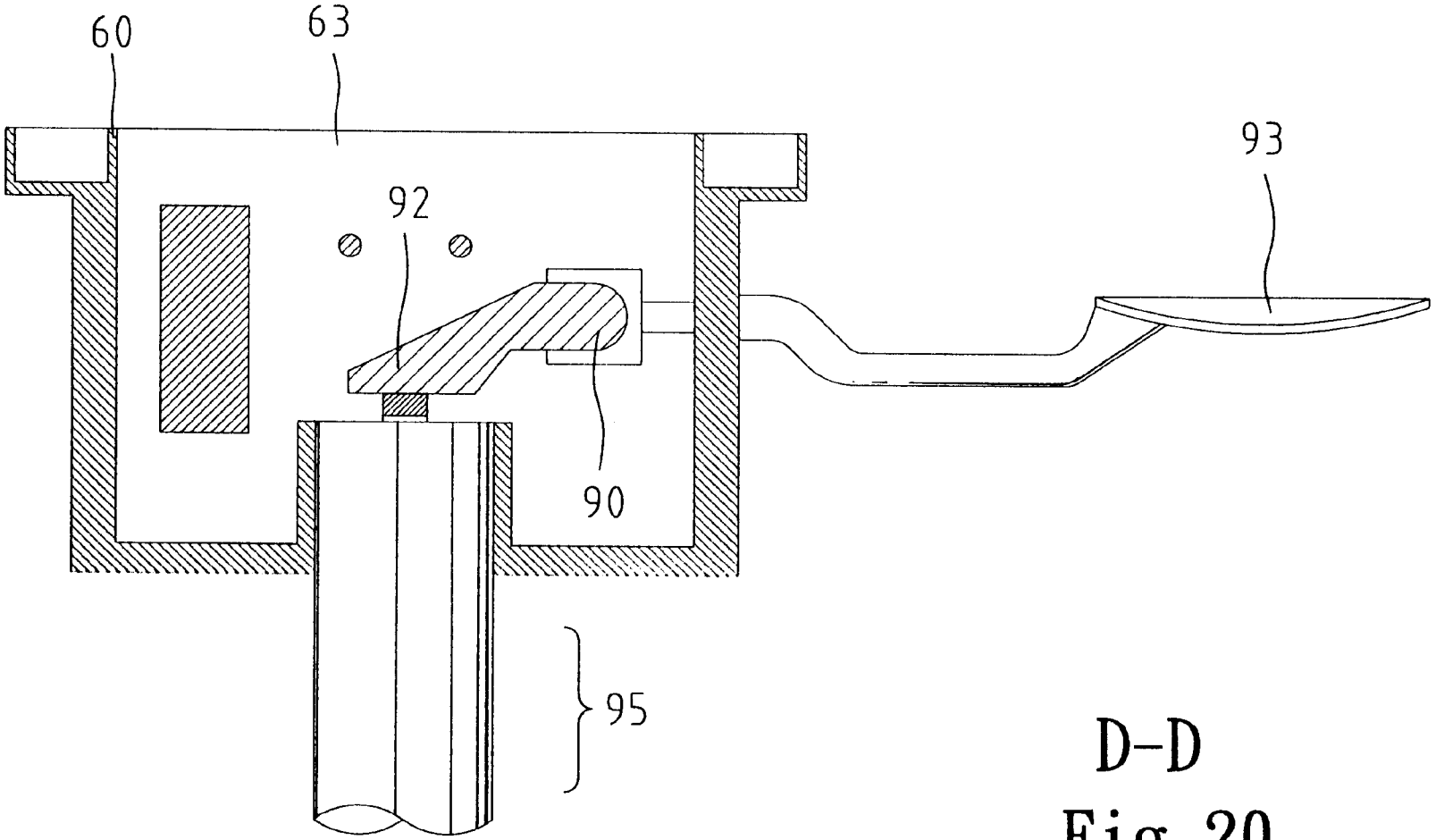
FIG. 20 is a sectional view taken along line D—D in FIG. 13.
Figure 21:
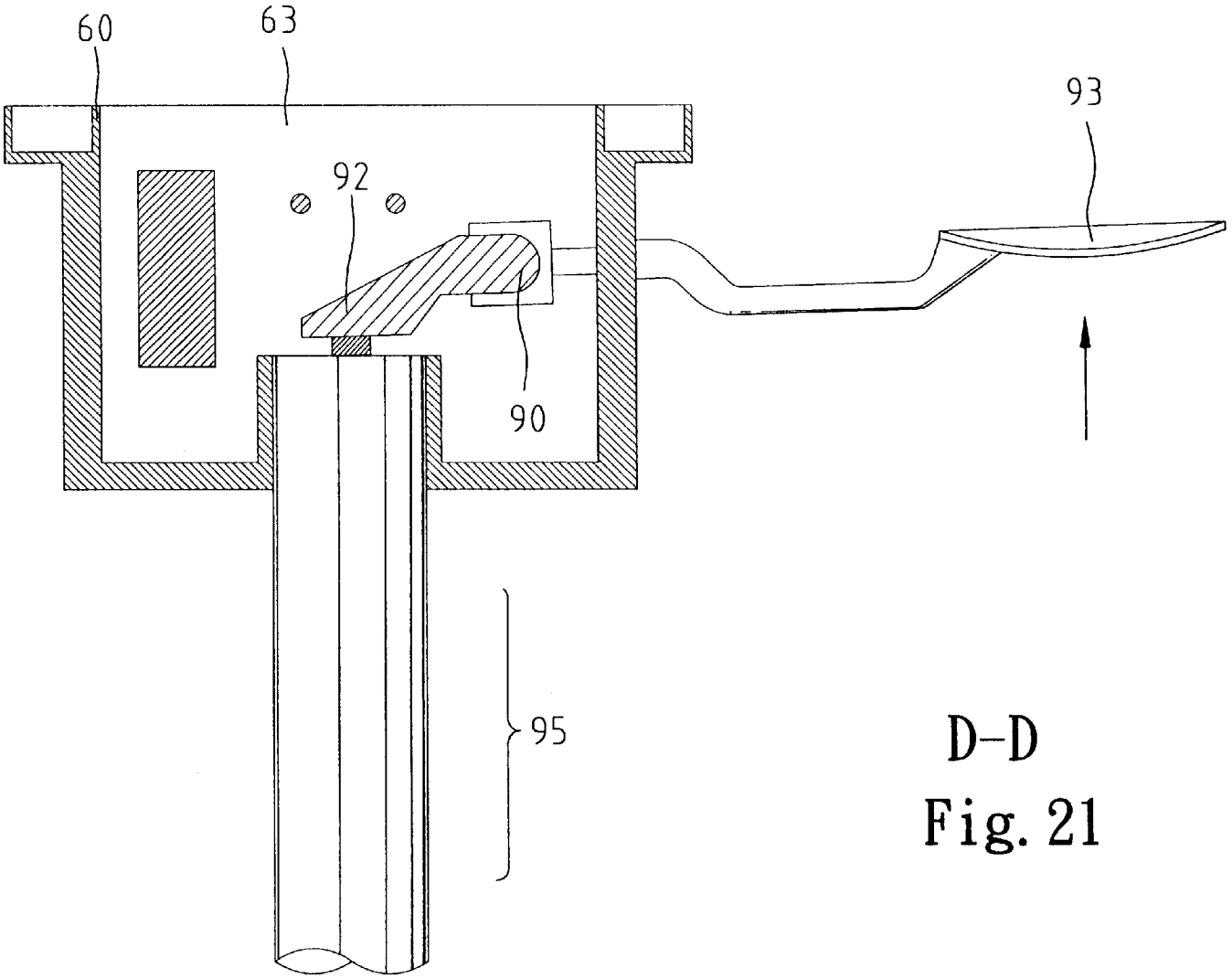
FIG. 21 is a sectional view similar to FIG. 20, wherein the second adjusting rod is pressed.

Referring to FIGS. 2, 12, and 13, the office chair further includes a substantially L-shape follower 90 received in the third compartment 63. The follower 90 includes a first end with a slot 91 that aligns with the side opening 67 of the third compartment 63 and that is securely engaged with an end 94 of a second adjusting rod 93 (FIG. 11). The other end of the adjusting rod 93 extends beyond the central seat 60 for manual operation. Referring to FIG. 20, the second end 92 of the follower 90 is operably connected to a pneumatic supporting means 95 mounted between the central seat 60 and a base 96 (with casters 97) of the office chair (FIG. 1). Thus, when the adjusting rod 93 is operated, the pneumatic supporting means 95 is actuated via transmission by the second end 92 of the follower 90, thereby elevating the central seat 60 (i.e., the chair seat 50) to a desired level, best shown in FIG. 21.

According to the above description, it is appreciated that the office chair in accordance with the present invention allows adjustment in the inclination angle and swaying limitation of the backrest in addition to the adjustment in the level of the backrest and the chair seat.

Although the invention has been explained in relation to its preferred embodiment, it is to be understood that many other possible modifications and variations can be made without departing from the spirit and scope of the invention as hereinafter claimed.

What is claimed is:

1. A chair comprising:

a backrest including a plurality of pairs of vertically spaced positioning grooves defined therein, a chair seat, a connecting means including a first end for engaging with the backrest and a second end for securely engaging with the chair seat, the first end of the connecting means including a compartment, an inner wall defining the compartment including a slot with two spaced horizontal sections, two slider members each including a locking member for releasably engaging with an associated said positioning groove of the backrest and a sliding rod slidably received in an associated said horizontal section of the slot in the connecting means, an actuator mounted in the compartment of the connecting means and slidable in a vertical direction, the actuator including two inclined faces, said sliding rod of each said slider member abutting against an associated said inclined face such that vertical movement of the actuator causes horizontal movements of the slider members along the slot, an elastic member attached between the sliding rods for biasing the locking members of the slider members to securely engage with an associated said pair of the positioning grooves, thereby retaining the backrest in a desired level relative to the chair seat, and a manually operable adjusting button securely attached to the actuator for urging the actuator to move in the vertical direction, such that the sliding rods of the slider members move away from each other to disengage the locking members of the slider members from the associated said pair of the positioning groove, thereby allowing the backrest to be movable in the vertical direction relative to the chair seat.

2. The chair as claimed in claim 1, wherein the backrest includes a first backrest part and a second backrest part securely attached to the first backrest part, wherein the first backrest part includes a block in which said plurality pairs of positioning grooves are defined.

3. The chair as claimed in claim 1, wherein the first end of the connecting means further includes an opening, and wherein the actuating member includes a second slot and the adjusting button includes an engaging piece extended through the opening for securely engaging with the second slot of the connecting means.

4. The chair as claimed in claim 1, further comprising:

a central seat secured to the chair seat, a swaying seat including a first end securely connected to the second end of the connecting means and a second end pivotally engaged with the central seat, an adjusting rod including a mediate portion pivotally connected to the central seat, a first end outside the central seat for manual operation and a second end, and an adjusting member slidably mounted to the central seat, the adjusting member being operably connected to the second end of the adjusting rod for releasable engagement with the second end of the swaying seat, the adjusting member being normally engaged with the second end of the swaying seat, wherein when the first end of the adjusting rod is moved in a first direction, the adjusting member is urged to disengage from the second end of the swaying seat, thereby allowing the swaying seat to be adjustable in an inclination angle relative to the chair seat, and when the first end of the adjusting rod is moved in an opposite second direction, the adjusting member is urged to engage with the second end of the swaying seat, thereby retaining the swaying seat in a desired inclination angle relative to the chair seat.

5. The chair as claimed in claim 4, wherein the adjusting member includes a first toothed section and the second end of the swaying seat includes a second toothed section to provide releasable engagement therebetween.

6. The chair as claimed in claim 4, further comprising:

a second elastic member having a first end securely attached to the swaying seat and a second end, an adjusting knob including a threaded stem, an abutting plate including a first end engaged with the central seat and a second end resting on the second end of the second elastic member, and a nut threadedly engaged on the threaded stem of the adjusting knob, a portion of the abutting plate being held in place relative to the second end of the second elastic member, wherein rotational movement of the adjusting knob causes the second end of the second elastic member to be moved relative to the first end of the second elastic member, thereby adjusting swaying extent of the swaying seat relative to the chair seat in forward and rear directions of the chair.

7. The chair as claimed in claim 1, further comprising:

a chair base, a pneumatic supporting means telescopically extended between the chair seat and the chair base of the chair, an adjusting rod having a first end for manual operation and a second end operably connected to the pneumatic supporting means for adjusting a level of the chair seat relative to the chair base upon manual operation on the first end of the adjusting rod.

8. The chair as claimed in claim 4, wherein the backrest includes a first backrest part and a second backrest part securely attached to the first backrest part, wherein the first backrest part includes a block in which said plurality pairs of positioning grooves are defined.

9. The chair as claimed in claim 4, wherein the first end of the connecting means further includes an opening, and wherein the actuating member includes a second slot and the adjusting button includes an engaging piece extended through the opening for securely engaging with the second slot of the connecting means.

10. The chair as claimed in claim 9, wherein the adjusting member includes a first toothed section and the second end of the swaying seat includes a second toothed section to provide releasable engagement therebetween.

11. A chair comprising:

a backrest, a chair, seat a connecting means including a first end for engaging with the backrest and a second end, a central seat secured to the chair seat, a swaying seat including a first end securely connected to the second end of the connecting, means and a second end pivotally engaged with the central seat, an adjusting rod including a mediate portion pivotally connected to the central seat, a first end outside the central seat for manual operation and a second end, an adjusting member slideably mounted to the central seat, the adjusting member being operably connected to the second end of the adjusting rod for releasable engagement with the second end of the swaying seat, the adusting member being normally engaged with the second end of the swaying seat, wherein when the first end of the adjusting rod is moved in a first direction, the adjusting member is urged to disengage from the second end of the swaying seat, thereby allowing the swaying seat to be adjustable in an inclination angle relative to the chair seat, and when the first end of the adjusting rod is moved in an opposite second direction, the adjusting member is urged to engage with the second end of the swaying seat, thereby retaining the swaying seat in a desired inclination angle relative to the chair seat, an elastic member having a first end securely attached to the swaying seat and a second end, an adjusting knob including a threaded stem, an abutting plate including a first end engaged with the central seat and a second end resting on the second end of the elastic member, and a nut threadedly engaged on the threaded stem of the adjusting knob, a portion of the abutting plate being held in place relative to the second end of the elastic member, wherein rotational movement of the adjusting knob causes the second end of the second elastic member to be moved relative to the first end of the second elastic member, thereby adjusting swaying extent of the swaying seat relative to the chair seat in forward and rear directions of the chair.

12. A chair comprising:

a backrest, a chair seat, a connecting means including a first end for engaging with the backrest and a second end, a central seat secured to the chair seat, a swaying seat including a first end securely connected to the second end of the connecting means and a second end pivotally engaged with the central seat, an adjusting rod including a mediate portion pivotally connected to the central seat, a first end outside the central seat for manual operation and a second end, an adjusting member slideably mounted to the central seat, the adjusting member being operable connected to the second end of the adjusting rod for releasable engagement with the second end of the swaying seat, the adjusting member being normally engaged with the second end of the swaying seat, wherein when the first end of the adjusting rod is moved in a first direction, the adjusting member is urged to disengage from the second end of the swaying seat, thereby allowing the swaying seat to be adjustable in an inclination angle relative to the chair seat, and when the first end of the adjusting rod is moved in an opposite second direction, the adjusting member is urged to engage with the second end of the swaying seat, thereby retaining the swaying seat in a desired inclination angle relative to the chair seat, a chair base, a pneumatic supporting means telescopically extended between the chair seat and the chair base of the chair, and a second adjusting rod having a first end for manual operation and a second end operably connected to the pneumatic supporting means for adjusting a level of the chair seat relative to the chair base upon manual operation on the first end of the second adjusting rod.

* * * * *